US007315113B2

(12) United States Patent
Nishiyama

(10) Patent No.: US 7,315,113 B2
(45) Date of Patent: Jan. 1, 2008

(54) COLOR CATHODE-RAY TUBE AND METHOD FOR PRODUCING THE SAME

(75) Inventor: Koji Nishiyama, Ibaraki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 52 days.

(21) Appl. No.: 11/247,366

(22) Filed: Oct. 11, 2005

(65) Prior Publication Data

US 2006/0076874 A1 Apr. 13, 2006

(30) Foreign Application Priority Data

Oct. 12, 2004 (JP) ..... 2004-297827

(51) Int. Cl.
*H01J 29/88* (2006.01)

(52) U.S. Cl. ..... 313/479; 313/417; 313/450; 313/456; 315/3; 315/382; 315/382.1; 445/34; 445/36

(58) Field of Classification Search ..... 313/479, 313/477, 364, 299, 107.5, 359.1
See application file for complete search history.

(56) References Cited

U.S. PATENT DOCUMENTS 5,113,112 A * 5/1992 Shimoma et al. ..... 313/412
5,952,777 A * 9/1999 Sugawara et al. ..... 313/479
6,433,469 B1 * 8/2002 Tsuruoka et al. ..... 313/414
6,445,117 B1 * 9/2002 Miyamoto et al. ..... 313/417
6,455,999 B1 * 9/2002 Hasegawa et al. .... 313/477 HC
6,515,424 B2 * 2/2003 Nakamura et al. ..... 315/3
6,646,381 B2 * 11/2003 Hasegawa et al. ..... 315/3
2002/0024284 A1 * 2/2002 Oda et al. ..... 313/413
2004/0232818 A1 * 11/2004 Miyamoto et al. ..... 313/441

FOREIGN PATENT DOCUMENTS

JP 58-197630 11/1983
JP 59-209250 11/1984
JP 10-188843 7/1998

* cited by examiner

*Primary Examiner*—Sikha Roy
*Assistant Examiner*—Brian T Schoolman
(74) *Attorney, Agent, or Firm*—Hamre, Schumann, Mueller & Larson, P.C.

(57) ABSTRACT

A conductive film isolated from an inner conductive film is formed on an inner wall of a neck. Assuming that, among a plurality of focusing electrodes constituting an electron gun, a position in a tube axis direction of an end on an anode side of an anode-side focusing electrode placed at a position closest to the anode side is P0; among electrodes supplied with substantially the same voltage as that of the anode-side focusing electrode and arranged continuously from the anode-side focusing electrode, a position in the tube axis direction of an end on a beam generating portion side of an electrode placed at a position closest to the beam generating portion side is P1; in the tube axis direction, a position of an end on the beam generating portion side of the conductive film is PL1 and a position of an end on the panel side of the conductive film is PL2, the position P0 is placed between the position PL1 and the position PL2. Assuming that the distances from the position P0 to the positions PL1, PL2, P1 are L1, L2, L3, respectively, relationships: L1>L2 and L1<L3 are satisfied. Furthermore, in the vertical direction, a range occupied by the conductive film includes and is larger than a range occupied by the anode-side focusing electrode. This can suppress the convergence drift of three electron beams to enhance color purity.

3 Claims, 7 Drawing Sheets

COLOR CATHODE-RAY TUBE AND METHOD FOR PRODUCING THE SAME

BACKGROUND OF THE INVENTION

1. Field of the Invention

The present invention relates to a color cathode-ray tube and a method for producing the same. More specifically, the present invention relates to a technique to improve the stability of convergence of three electron beams in a color cathode-ray tube.

2. Description of Related Art

A conventional color cathode-ray tube includes a glass bulb (envelope) having a funnel composed of a funnel portion and a neck, and a panel, and an inner space of the glass bulb is kept under vacuum. A phosphor screen is formed on an inner wall of the panel. An electron gun is housed in the neck. On an outer circumferential surface of the funnel, a deflector deflecting electron beams emitted from the electron gun is provided. Furthermore, an inner conductive film electrically connected to an anode is formed in the funnel portion and in a part of the neck.

The electron gun includes a first electrode group (beam generating portion) for taking out electron beams and controlling a beam shape, and a second electrode group (including a plurality of focusing electrodes and an anode) for finally focusing the electron beams on the phosphor screen. Generally, three electron beams arranged in a line, composed of a center electron beam and two side electron beams on both sides of the center electron beam, are emitted from the electron gun. In the color cathode-ray tube, the three electron beams are converged on the phosphor screen, and each of the three electron beams is focused on the phosphor screen. However, due to the change with time in a potential (hereinafter, which also may be referred to as a "neck potential") of an inner wall of the neck, the convergence state of the three electron beams varies with time. This causes color displacement. More specifically, the neck potential generally has a potential distribution depending upon the position of the neck, which forms an electric field (hereinafter, which also may be referred to as a "penetration electric field") that penetrates each gap between the electrodes of the electron gun. The electric field acting on each electron beam is a complex electric field defined by the electric field formed by each electrode and the penetration electric field depending upon the neck potential. Therefore, if the penetration electric field changes, the complex electric field also changes, which varies the path of each electron beam. In particular, the two side electron beams are likely to be influenced by the change in the penetration electric field, so that the paths thereof vary more significantly compared with that of the center electron beam. Consequently, the landing positions of the three electron beams are shifted to cause a convergence drift, leading to color displacement.

Hereinafter, the reason why the penetration electric field changes will be described. The inner conductive film having the same potential as that of the anode is formed on an inner wall of the glass bulb, so that the neck potential immediately after the application of a predetermined voltage to each electrode has a potential distribution in which a potential decreases from an end of the inner conductive film on the neck side to an end of the neck on an opposite side of the panel. However, with the passage of time, floating electrons generated in an inner space of the neck strike the inner wall of the neck, and secondary electrons larger in number than that of the struck floating electrons are released from the neck. This increases the neck potential gradually. Consequently, the complex electric field acting on each electron beam changes with time.

As a technique of reducing the convergence drift caused by the change in the penetration electric field, a configuration is known in which a conductive film is allowed to adhere to a region on the inner wall of the neck opposed in a horizontal direction to the gap between two electrodes (focusing electrodes) other than an electrode (anode) supplied with the highest voltage among the electrodes constituting the second electrode group (e.g., see JP 10(1998)-188843 A). The horizontal direction is the same as an arrangement direction of the three electron beams. Hereinafter, this configuration will be referred to as a "conventional example".

In the above-mentioned conventional example, although the conductive film is formed in the region on the inner wall of the neck opposed in the horizontal direction to the gap between the focusing electrodes, the conductive film is not formed in a region on the inner wall of the neck opposed in the horizontal direction to the gap between the anode and the focusing electrode (hereinafter, referred to as an "anode-side focusing electrode") closest to the anode. Therefore, the effect of reducing a convergence drift is small. This is because, in the penetration electric field to each gap between the electrodes constituting the second electrode group, the penetration electric field to the gap between the anode-side focusing electrode and the anode most contributes to a convergence drift. The reason for this is as follows. First, a region on the inner wall of the neck opposed to the anode-side focusing electrode is close to the inner conductive film, so that the region is charged to a relatively high potential. Thus, the intensity of the penetration electric field to the gap between the anode-side focusing electrode and the anode is large, and its change is large. Second, by applying a predetermined voltage to each electrode, a main lens is formed between the anode-side focusing electrode and the anode. If the electric field distribution constituting the main lens is changed by the penetration electric field, even if the change in the electric field distribution constituting a lens between the other electrodes can be suppressed, a convergence drift may occur.

As a method for reducing the influence of the penetration electric field on the gap between the anode-side focusing electrode and the anode, decreasing the gap between these electrodes can be considered. However, this method is not preferable because the withstand voltage characteristics are degraded (e.g., a spark is generated between the electrodes).

SUMMARY OF THE INVENTION

According to the present invention, the color purity of a color display is enhanced by suppressing a convergence drift without degrading the withstand voltage characteristics between an anode-side focusing electrode and an anode. Furthermore, according to the present invention, in order to enhance the color purity of a color display, a method for producing a color cathode-ray tube is improved.

A color cathode-ray tube according to the present invention includes: an envelope having a funnel composed of a funnel portion and a neck, and a panel; a phosphor screen provided on an inner wall of the panel; an electron gun provided in an inner space of the neck, and having a beam generating portion for controlling generation of three electron beams arranged in an in-line direction, a plurality of focusing electrodes for controlling a focusing of the three electron beams, and an anode; and an inner conductive film formed on an inner wall of the funnel portion and in a part of an inner wall of the neck, and electrically connected to the anode. The color cathode-ray tube according to the present invention further includes a conductive film isolated from the inner conductive film on the inner wall of the neck.

Assuming that, among the plurality of focusing electrodes, a position in a tube axis direction of an end on the anode side of an anode-side focusing electrode placed at a position closest to the anode side is P0, among electrodes supplied with substantially the same voltage as that of the anode-side focusing electrode and arranged continuously from the anode-side focusing electrode, a position in the tube axis direction of an end on the beam generating portion side of an electrode placed at a position closest to the beam generating portion side is P1, and in the tube axis direction, a position of an end on the beam generating portion side of the conductive film is PL1, and a position of an end on the panel side of the conductive film is PL2, in the tube axis direction, the position P0 is placed between the position PL1 and the position PL2.

Assuming that a distance in the tube axis direction from the position P0 to the position PL1 is L1, a distance in the tube axis direction from the position P0 to the position PL2 is L2, and a distance in the tube axis direction from the position P0 to the position P1 is L3, the following relationships:

$$L1>L2$$

$$L1<L3$$

are satisfied.

In a direction orthogonal to a tube axis and the in-line direction, a range occupied by the conductive film includes and is larger than a range occupied by the anode-side focusing electrode.

A method for producing a color cathode-ray tube according to the present invention includes: forming a phosphor screen on an inner wall of a panel (phosphor screen forming process); forming an inner conductive film on an inner wall extending from a funnel portion to a part of a neck in a funnel (inner conductive film forming process); connecting the panel to the funnel to form an envelope (envelope forming process); fixing an electron gun having a beam generating portion, a plurality of focusing electrodes, and an anode to an inner space of the neck (electron gun fixing process); and an exhausting process of decompressing an inner space of the envelope to seal the envelope.

The method for producing a color cathode-ray tube according to the present invention further includes a heating process of, after the exhausting process, heating an anode-side focusing electrode placed at a position closest to the anode side among the plurality of focusing electrodes, thereby vapor-depositing a material constituting the anode-side focusing electrode on an inner wall of the neck to form a conductive film isolated from the inner conductive film.

DETAILED DESCRIPTION OF THE INVENTION

Figure 1:
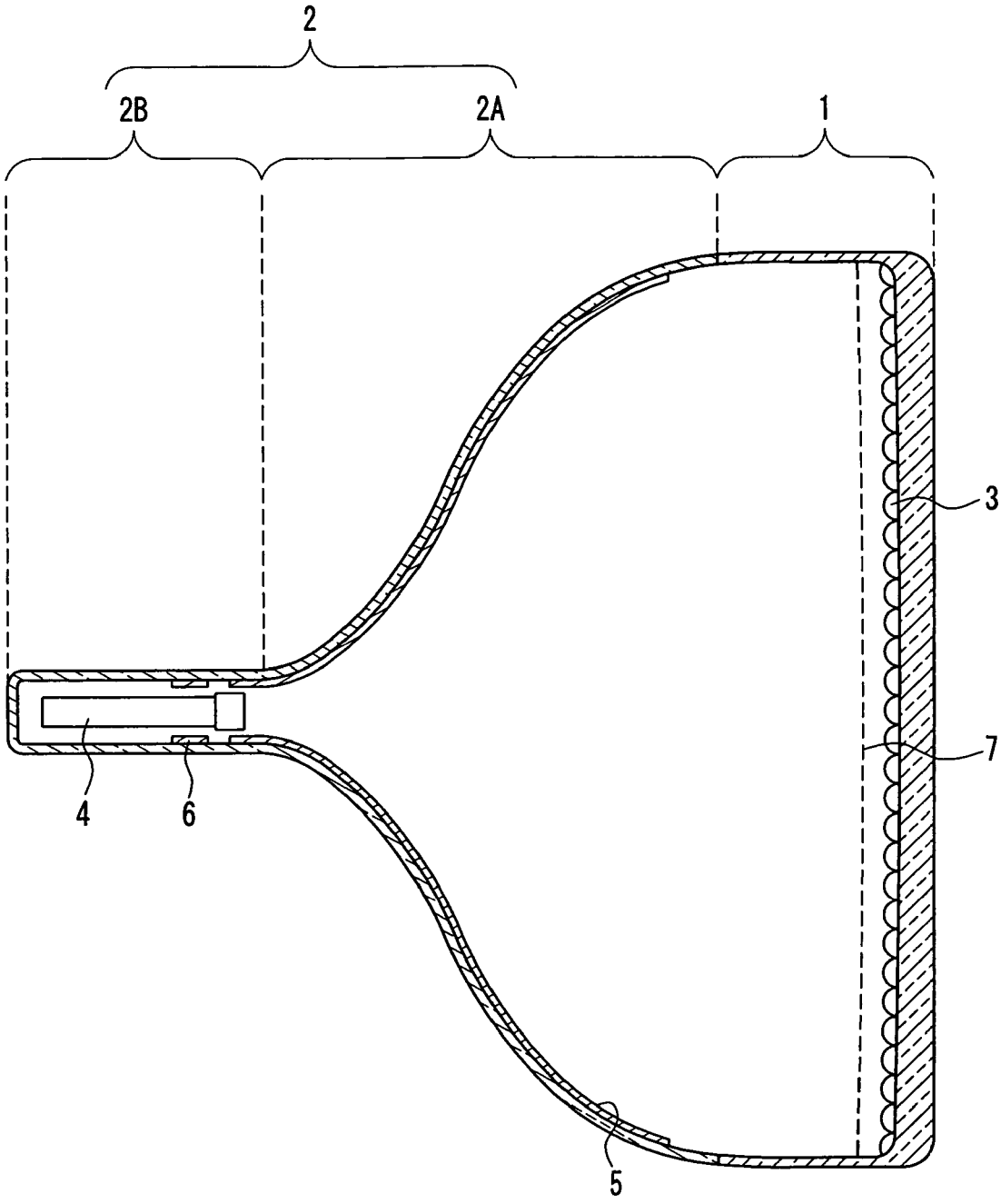
FIG. 1 is a schematic cross-sectional view showing an example of an entire configuration of a color cathode-ray tube according to Embodiment 1 of the present invention.

A color cathode-ray tube of the present invention includes a conductive film in a region i.e., a region on an inner wall of a neck, the position in a tube axis direction of which is the same as that of a main lens formation region. The region on the inner wall of the neck also may be referred to as a "main lens opposed region") on the inner wall of the neck opposed to a gap (hereinafter, which also may be referred to as the "main lens formation region") between an anode-side focusing electrode and an anode. The formation region of the conductive film is defined so as to be associated with the focusing electrode. Because of this, the convergence drift of three electron beams can be suppressed, whereby the color purity of a color display can be enhanced.

Furthermore, according to the method for producing a color cathode-ray tube of the present invention, the conductive film can be formed in the main lens opposed region. Therefore, a color cathode-ray tube can be produced in which the convergence drift of three electron beams is suppressed, whereby the color purity of a color display is enhanced.

As described above, a color cathode-ray tube according to the present invention includes: an envelope having a funnel composed of a funnel portion and a neck, and a panel; a phosphor screen; an electron gun having a beam generating portion, a plurality of focusing electrodes, and an anode; an inner conductive film; and a conductive film isolated from the inner conductive film. The color cathode-ray tube according to the present invention further may include a deflector deflecting electron beams by an electric action or a magnetic action, a shadow mask for selecting a color, a magnetic shield for reducing the disturbance of the paths of the electron beams caused by geomagnetism, and the like. The color cathode-ray tube according to the present invention may have any known configuration outside of the above-mentioned conductive film.

The conductive film is formed in the main lens opposed region. More exactly, in the tube axis direction, the position P0 regarding the anode-side focusing electrode defined as described above is placed between the positions PL1 and PL2 regarding the conductive film. Furthermore, regarding the formation region of the conductive film in the tube axis direction, relationships: L1>L2 and L1<L3 are satisfied. Because of this, the release gain (the number of secondary electrons released in the case where one electron strikes the conductive film) of secondary electrons with respect to the conductive film becomes smaller than that with respect to the neck (insulating material), and the like, whereby the change with time in a potential of the main lens opposed region of the inner wall of the neck portion can be suppressed. Consequently, the change with time in a convergence state of three electron beams can be suppressed, and the occurrence of color displacement also can be suppressed.

Furthermore, regarding the direction (circumferential direction) around the tube axis, the conductive film may be formed over the entire circumference or partially. It should be noted that, in a direction (hereinafter, referred to as a "vertical direction") orthogonal to the tube axis and the in-line direction, a range occupied by the conductive film includes and is larger than a range occupied by the anode-side focusing electrode. The distance to the anode-side focusing electrode from the region on the inner wall of the neck opposed in the in-line direction (hereinafter, referred to as a "horizontal direction") to the anode-side focusing electrode is short. Thus, if the conductive film is formed in a region on the inner wall of the neck, including the region on the inner wall of the neck opposed in the horizontal direction to the anode-side focusing electrode, the potential of the conductive film becomes stable at a value close to the potential of the anode-side focusing electrode, so that the change amount of a penetration electric field to the main lens formation region becomes small, which can decrease a convergence drift.

In the case of forming the conductive film only in a part of the inner wall of the neck in the circumferential direction, it is preferable to form the conductive film in the region on the inner wall of the neck opposed in the horizontal direction to the main lens formation region. This is because each of the side electron beams passes through the vicinity of the region opposed in the horizontal direction to the main lens formation region, rather than the region opposed in the vertical direction to the main lens formation region, on the inner wall of the neck.

It is preferable that the conductive film is formed over the entire surface of the main lens opposed region. That is, it is preferable that the conductive film is formed over the entire circumference in the circumferential direction, and in the tube axis direction, the position PL1 of an end on the beam generating portion side of the conductive film is placed on the beam generating portion side with respect to the position P0 of an end on the anode side of the anode-side focusing electrode, and the position PL2 of an end on the panel side of the conductive film is placed on the panel side with respect to the position of an end on the focusing electrode side of the anode. According to this preferable configuration, the change with time of a neck potential can be suppressed over the entire main lens opposed region. The range occupied by the conductive film in the tube axis direction may be overlapped with the range occupied by the anode in the tube axis direction. In this case, a spark is likely to be generated between the conductive film and the anode. Thus, it is preferable that the overlapped width therebetween in the tube axis direction should be minimized.

In the color cathode-ray tube according to the present invention, it is preferable that the conductive film is a vapor-deposited metal film. If the conductive film is a metal film, the conductivity thereof is higher than that of a conductive film of any other material, so that the film thickness of the conductive film can be decreased. Furthermore, if the conductive film is a vapor-deposited film, after a material for forming the conductive film is placed in an inner space of the envelope, and an exhausting process of decompressing the inner space of the envelope is performed, the conductive film can be formed easily by vacuum vapor deposition. The material for forming the vapor-deposited metal film may be a part of the anode-side focusing electrode, or a conductor such as a metal foil or a metallic ribbon provided separately on the anode-side focusing electrode.

In the color cathode-ray tube according to the present invention, it is preferable that a gap between the anode-side focusing electrode and the anode is 1.0 mm or more. According to this configuration, the withstand voltage characteristics between the anode-side focusing electrode and the anode can be enhanced. It is preferable that the gap between the anode-side focusing electrode and the anode is 2.0 mm or less. More preferably, the gap is in a range of 1.0 mm to 1.5 mm.

As described above, a method for producing a color cathode-ray tube according to the present invention includes a phosphor screen forming process, an inner conductive film forming process, an envelope forming process, an electron gun fixing process, an exhausting process, and a heating process. In the case of producing a color cathode-ray tube further including a deflector, a shadow mask, a magnetic shield, and the like, the method of the present invention further includes a process of producing and assembling them. According to the method for producing a color cathode-ray tube according to the present invention, in the processes other than the heating process of forming a conductive film, any known technique may be used. According to this production method, a conductive film can be formed easily and exactly. In the heating process, as a method for heating an anode-side focusing electrode, any known method may be used. The conductive film formed in the heating process may contain only a material constituting the anode-side focusing electrode, or further may contain a material constituting another electrode such as an anode. This production method is one method for producing a color cathode-ray tube of the present invention, and the color cathode-ray tube of the present invention may be produced by another production method, as long as a conductive film is formed at a predetermined position.

In the method for producing a color cathode-ray tube according to the present invention, it is preferable that, in the heating process, the heating is high-frequency heating using an external coil. If this method is applied, the. anode-side focusing electrode can be heated efficiently to a higher temperature than that of the other electrodes. Furthermore, the surface (hereinafter, referred to as an "outer surface") of the anode-side focusing electrode opposed to the neck can be heated selectively.

In the method for producing a color cathode-ray tube according to the present invention, it is preferable that, in the heating process, a highest temperature $T_{max}$ (see FIG. 6) of the anode-side focusing electrode is in a range of 900° C. to 1100° C. In the present invention, the temperature of the anode-side focusing electrode refers to the temperature of a site having a highest temperature on the outer surface of the anode-side focusing electrode. Thus, the highest temperature $T_{max}$ of the anode-side focusing electrode in the heating process refers to the highest temperature among those of sites on the outer surface of the anode-side focusing electrode, respectively showing a highest temperature at each time in the heating process. If this method is applied while the changes in a position and a shape of the anode-side focusing electrode are being suppressed, the material constituting the anode-side focusing electrode can be vapor-deposited efficiently on the inner wall of the neck.

If the highest temperature $T_{max}$ of the anode-side focusing electrode is less than 900° C., the material constituting the anode-side focusing electrode is unlikely to evaporate from the surface thereof, so that it takes a long period of time to form a conductive film with a desired film thickness. If heating is performed for a long period of time, the temperature of an insulative holding member such as bead glass holding the anode-side focusing electrode is likely to rise, with the result that the position of the anode-side focusing electrode is shifted easily. On the other hand, when the highest temperature $T_{max}$ exceeds 1100° C., the temperature of a member placed in the vicinity of the anode-side focusing electrode rises due to a leakage magnetic field and radiant heat, which degrades the characteristics of the member. Furthermore, the insulative holding member is likely to be heated to a melting point or higher, so that the position of the anode-side focusing electrode is shifted easily. Thus, it is preferable that the highest temperature $T_{max}$ of the anode-side focusing electrode is set in the above range. Furthermore, it is preferable that the highest temperature $T_{max}$ is in a range of 900° C. to 950° C.

In the method for producing a color cathode-ray tube according to the present invention, it is preferable that, in the heating process, over an entire period of time during which a temperature of the anode-side focusing electrode is 900° C. or higher, a value obtained by integrating a differential temperature, obtained by subtracting 900° C. from the temperature of the anode-side focusing electrode, is in a range of 0° C.·sec to 2500° C.·sec. Because of this, while the changes in a position and a shape of the anode-side focusing electrode are being suppressed, a conductive film with an optimum thickness can be formed.

Embodiment 1

In Embodiment 1,a specific example of a color cathode-ray tube according to the present invention will be described. FIG. 1 is a schematic cross-sectional view showing an example of the overall configuration of the color cathode-ray tube.

As shown in FIG. 1, the color cathode-ray tube includes an envelope having a funnel 2 composed of a funnel portion 2A and a neck 2B, and a panel 1, a phosphor screen 3 formed on an inner wall of the panel 1, an electron gun 4 formed in an inner-space of the neck 2B, an inner conductive film 5 formed on an inner wall of the funnel portion 2A and in a part of an inner wall of the neck 2A, a conductive film 6 formed in a part of the inner wall of the neck 2B, a shadow mask 7, and a deflector (not shown). The color cathode-ray tube according to the present invention may be the same as any known color cathode-ray tube, except for the conductive film 6. The inner space of the envelope is kept under vacuum of about $1.33\times10^{-3}$ Pa ($10^{-5}$ Torr).

Figure 2:
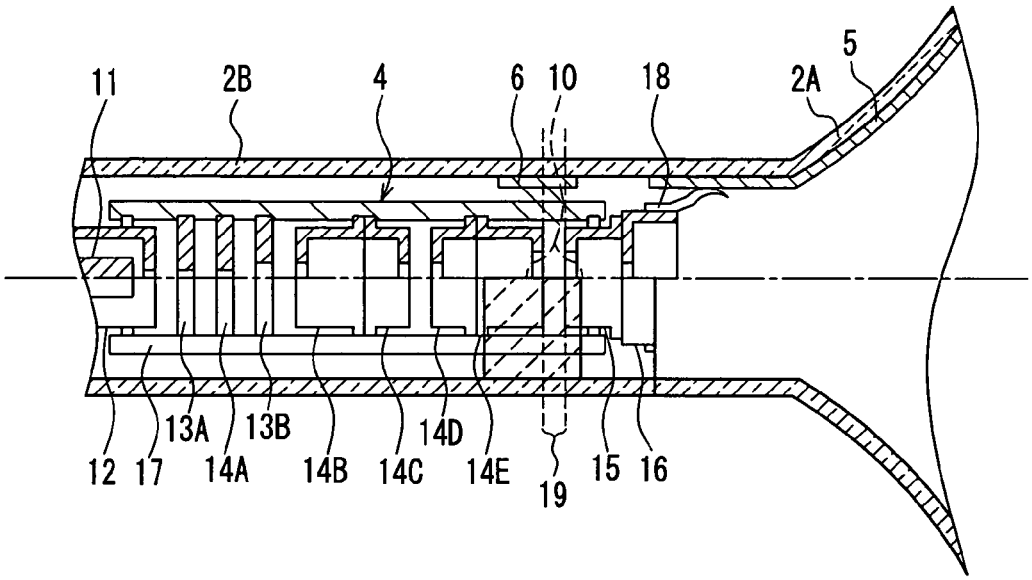
FIG. 2 is a schematic partial cross-sectional side view showing an exemplary configuration in the vicinity of an electron gun of the color cathode-ray tube according to Embodiment 1 of the present invention.

FIG. 2 is a schematic partial cross-sectional side view showing an example of a configuration in the vicinity of the electron gun of the color cathode-ray tube. In FIG. 2, the upper side from a tube axis represented by alternate long and short dashed lines represents a cross-sectional view, and the lower side therefrom represents a semi-perspective view.

As shown in FIG. 2, the electron gun 4 is composed of three cathodes 11 (arranged in a direction perpendicular to the drawing surface of FIG. 2), a control electrode 12, two accelerating electrodes 13A, 13B, a plurality of focusing electrodes 14A to 14E, an anode (final accelerating electrode) 15, and a shield cup 16. Apertures through which the three electron beams pass are formed in each of the electrodes and the shield cup 16. The three cathodes 11, the control electrode 12, and the two accelerating electrodes 13A, 13B constitute a beam generating portion.

Each electrode is fixed at a predetermined interval from a neighboring electrode by a pair of insulative holding portions 17 made of bead glass or the like. By applying a predetermined voltage to each electrode, a main lens 10 is formed in a gap between the focusing electrode (anode-side focusing electrode) 14E placed at a position closest to the anode 15 side among the plurality of focusing electrodes 14A to 14E and the anode 15. The voltages applied to the electrodes are as follows: the two accelerating electrodes 13A, 13*b* are supplied with a voltage of about 600 V, the focusing electrodes 14A to 14E are supplied with a voltage of about 8 kV, and the anode 15 is supplied with a voltage of about 30.5 kV The three electron beams emitted from the electron gun 4 travel to the phosphor screen 3 side, and are focused on the phosphor screen 3 (see FIG. 1).

The anode-side focusing electrode 14E and the anode 15 are made of stainless steel. The width of the gap between the anode-side focusing electrode 14E and the anode 15 is 1.0 mm or more.

The inner conductive film 5 is formed on the inner wall from the funnel portion 2A to a site opposed to the center in the tube axis direction of the shield cup 16 in the neck 2B. The inner conductive film 5 is provided so that a voltage is applied to the anode 15 via a centering spring 18 and the shield cup 16. That is, the inner conductive film 5 and the anode 15 have substantially the same potential.

The conductive film 6 is formed in a region including at least a part of a main lens opposed region 19 on the inner wall of the neck 2B in the tube axis direction. Herein, care should be taken that the conductive film 6 is isolated from the inner conductive film 5.

Figure 3:
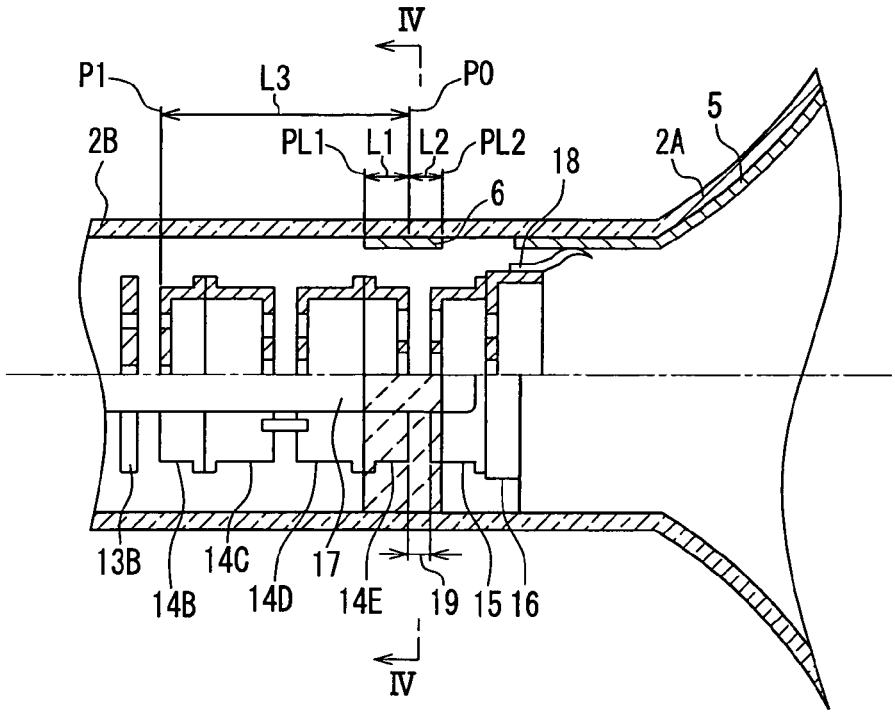
FIG. 3 is a schematic partial cross-sectional side view showing an exemplary configuration in the vicinity of focusing electrodes of the color cathode-ray tube according to Embodiment 1 of the present invention.

FIG. 3 is a schematic partial cross-sectional side view showing an exemplary configuration in the vicinity of the focusing electrodes of the color cathode-ray tube of Embodiment 1. In FIG. 3, the upper side from the tube axis represented by alternate long and short dashed lines represents a cross-sectional view, and the lower side therefrom represents a semi-perspective view. The range occupied by the conductive film 6 of the color cathode-ray tube of Embodiment 1 in the tube axis direction will be described with reference to FIG. 3.

As shown in FIG. 3, it is assumed that the position in the tube axis direction of an end on the anode 15 side of the anode-side focusing electrode 14E is P0. It is assumed that, among the electrodes supplied with substantially the same voltage as that of the anode-side focusing electrode 14E and placed continuously from the anode-side focusing electrode 14E, the position in the tube axis direction of an end on the beam generating portion side of the focusing electrode 14B placed at a position closest to the beam generating portion is P1. Herein, although the focusing electrode 14A (see FIG. 2)

is supplied with the same voltage as that of the anode-side focusing electrode 14E, the accelerating electrode 13B supplied with a voltage different from that of the anode-side focusing electrode 14E is present between the focusing electrode 14A and the anode-side focusing electrode 14E; therefore, the focusing electrode 14A cannot be an electrode defining the position P1. The electrodes being "arranged continuously" includes both the case where a plurality of electrodes are adjacent to each other with a gap therebetween, and the case where a plurality of electrodes are connected to each other.

Furthermore, it is assumed that, in the tube axis direction, the position of an end on the beam generating portion side of the conductive film 6 is PL1, and the position of an end on the panel side of the conductive film 6 is PL2.

In the present embodiment, in the tube axis direction, the position P0 is placed between the position PL1 and the position PL2.

Furthermore, assuming that the distance in the tube axis direction from the position P0 to the position PL1 is L1, the distance in the tube axis direction from the position P0 to the position PL2 is L2, and the distance in the tube axis direction from the position P0 to the position P1 is L3, relationships: L1>L2 and L1<L3 are satisfied.

The relationships: L1>L2 and L1<L3 being satisfied means that most of the conductive film 6 is opposed to the anode-side focusing electrode 14E and the electrode supplied with the same voltage as that of the anode-side focusing electrode 14E. Thus, the potential of the conductive film 6 becomes stable at a value close to the potential of the anode-side focusing electrode 14E. Accordingly, the change amount of the neck potential decreases, and the change in the penetration electric field to the main lens formation region decreases, whereby the convergence drift can be suppressed.

In the case where a relationship: L1≦L2 is satisfied, a half or more of the conductive film 6 is opposed to the main lens formation region or the anode 15. Thus, the potential of the conductive film 6 becomes stable at a value between the potential of the anode-side focusing electrode 14E and the potential of the anode 15. Consequently, a convergence drift increases.

In the case where a relationship: L1≧L3 is satisfied, the conductive film 6 is opposed to the electrode supplied with a voltage different from that of the anode-side focusing electrode 14E. Thus, the potential of the conductive film 6 becomes smaller than that of the anode-side focusing electrode 14E, which disturbs the electric field in the main lens formation region, and causes a focus defect. Furthermore, when the potential of the conductive film 6 is lower than that of the anode-side focusing electrode 14E, the potential difference between the conductive film 6 and the anode 15 increases, which may cause spark therebetween.

Figure 4:
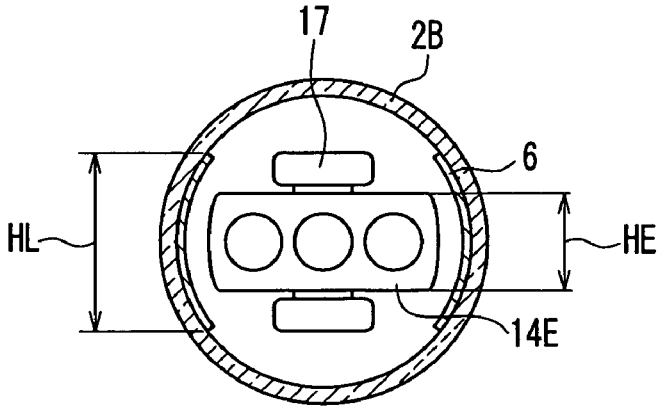
FIG. 4 is a cross-sectional view taken along a line IV-IV in FIG. 3.

FIG. 4 is a cross-sectional view taken along a line IV-IV perpendicular to the tube axis, passing through the main lens opposed region 19 in FIG. 3. The range occupied by the conductive film 6 of the color cathode-ray tube of Embodiment 1 in the vertical direction will be described with reference to FIG. 4. In the vertical direction, the range occupied by the conductive film 6 includes and is larger than a range occupied by the anode-side focusing electrode 14E. Because of this, the potential of the conductive film 6 becomes stable at a value close to the potential of the anode-side focusing electrode 14E. Thus, the change amount of the neck potential decreases, and the change in the penetration electric field to the main lens formation region decreases, so that the convergence drift can be suppressed.

In the present invention, the "range occupied by the anode-side focusing electrode 14E in the vertical direction" refers to the range occupied by a vertical direction size HE of a tubular portion of the anode-side focusing electrode 14E, and a protrusion (e.g., lug) such as a portion embedded in the insulative holding portions 17 is not considered. This is because the influence of the protrusion on the neck potential is small.

Figure 5:
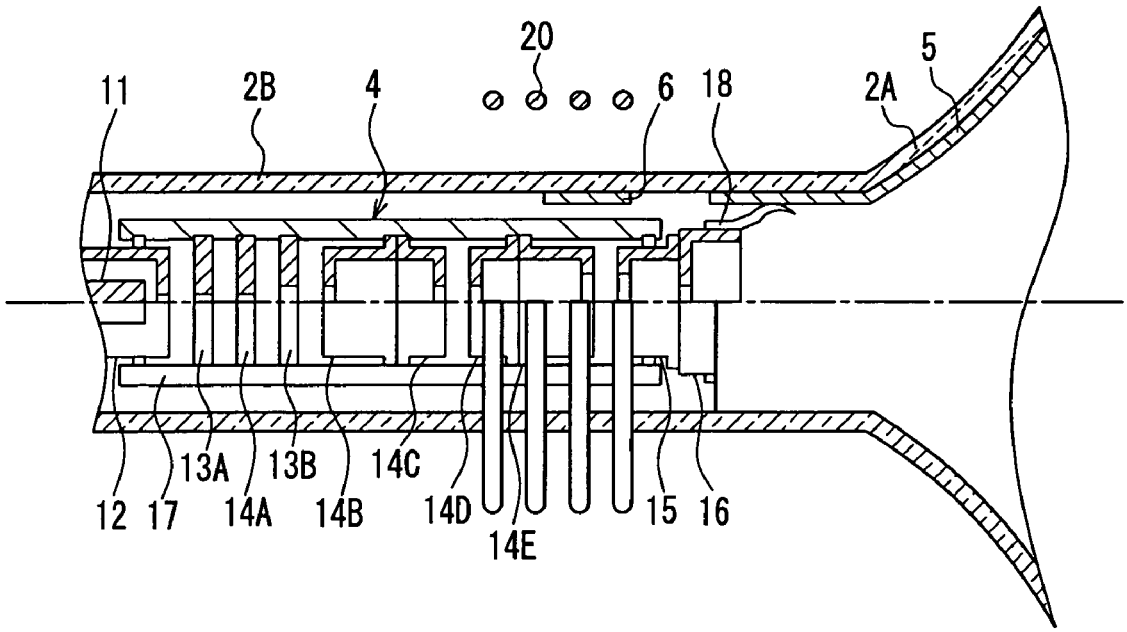
FIG. 5 is a schematic cross-sectional view illustrating an exemplary heating process in a method for producing the color cathode-ray tube according to Embodiment 1 of the present invention.

The method for producing a color cathode-ray tube according to Embodiment 1 will be described. FIG. 5 is a schematic cross-sectional view illustrating an example of a heating process in the method for producing a color cathode-ray tube. The processes other than the heating process will be described with reference to FIG. 1 for convenience.

The panel 1, the funnel 2 having the funnel portion 2A and the neck 2B, and the electron gun 4 are previously produced, respectively. On the inner wall of the produced panel 1, the phosphor screen 3 is formed (phosphor screen forming process). Furthermore, on the inner wall of the produced funnel 2, the inner conductive film 5 is formed (inner conductive film forming process). After the phosphor screen forming process and the inner conductive film forming process are completed, the panel 1 and the funnel 2 are connected to each other to form the envelope (envelope forming process). After the envelope forming process is completed, the electron gun 4 is fixed in the inner space of the neck 2B of the envelope (electron gun fixing process). After the electron gun fixing process is completed, the inner space of the envelope is decompressed to be sealed (exhausting process).

Figure 6:
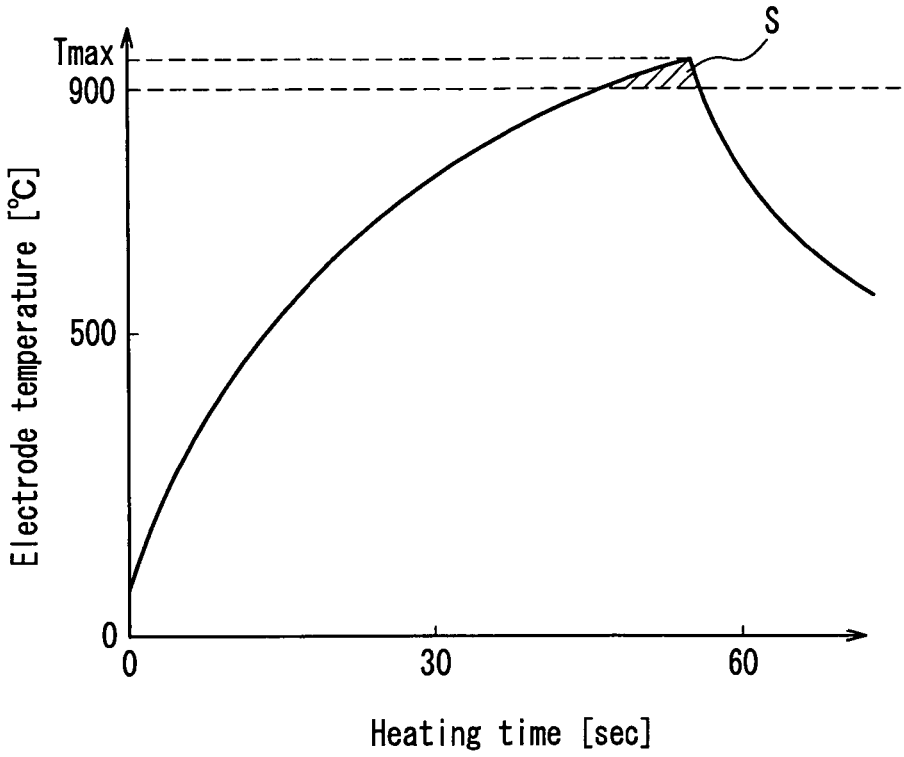
FIG. 6 is a graph showing an exemplary transition of a temperature (electrode temperature) of an anode-side focusing electrode with respect to a heating time in the heating process in the method for producing the color cathode-ray tube according to Embodiment 1 of the present invention.

After the exhausting process is completed, as shown in FIG. 5, a coil (external coil) 20 is placed so as to surround at least a part of the anode-side focusing electrode 14E of the electron gun 4 from the outside of the neck 2B, and a high-frequency current is allowed to flow through the coil 20 (heating process). Herein, the heating time condition in the heating process will be described with reference to FIG. 6. FIG. 6 is a graph showing an exemplary transition of the temperature of the anode-side focusing electrode 14E with respect to the heating time. In FIG. 6, the heating time does not mean a period of time during which a current flows, but a period of time from a point when a current starts flowing to a point when the anode-side focusing electrode 14E returns to room temperature.

In the heating process, as shown in FIG. 6, it is preferable to control the value of a current flowing through the coil 20 so as to satisfy the following two conditions. The first condition is that the highest temperature of the anode-side focusing electrode 14E becomes 900° C. to 1100° C. (heating condition 1). The second condition is that, over the entire heating time during which the temperature of the anode-side focusing electrode 14E satisfies 900° C. or higher, a value (area S of a shaded portion in FIG. 6) obtained by integrating a differential temperature, obtained by subtracting 900° C. from the temperature of the anode-side focusing electrode 14E, becomes 0° C.·sec to 2500° C.·sec (heating condition 2).

In the heating process, there is no particular limit on the shape of the coil 20. Furthermore, it is preferable to optimize the shape and the arrangement of the coil 20, because a site having the highest temperature on the outer surface of the anode-side focusing electrode 14E varies depending upon the shape and the arrangement of the coil 20.

In the heating process, it is preferable that the temperature of the anode 15 is kept at 900° C. or lower. This is because, when the temperature of the anode 15 exceeds 900° C., the material constituting the anode 15 starts evaporating from the anode 15, and a conductive film is formed in a region of the inner wall of the neck 2B, opposed to the anode 15, which is likely to cause a defect in withstand voltage characteristics. Furthermore, it is preferable that the temperature of the centering spring 18 attached to the shield cup 16 is kept at 570° C. or lower. This is because, when the temperature of the centering spring 18 exceeds 570° C., the spring characteristics of the centering spring 18 are degraded. When the temperature of the anode-side focusing electrode 14E exceeds 1100° C., the temperature of the centering spring 18 may exceed 570° C. due to the leakage magnetic field from the coil 20 and the radiant heat from the anode-side focusing electrode 14E.

After the exhausting process is completed, in the same way as in the case of producing a known color cathode-ray tube, in order to improve the vacuum level in the inner space of the envelope, a getter-flash process of performing high-frequency heating with a coil, a withstand voltage treatment process for suppressing the generation of a leakage current between the electrodes during an operation, a cathode activating process of thermally activating the cathode by heating the cathode 11 with a heater or the like, and applying a voltage between the cathode 11 and the control electrode 12, and the like are performed. There is no particular limit to the order between these processes and the above-mentioned heating process. The color cathode-ray tube of Embodiment 1 shown in FIG. 1 is completed through each of the above processes.

In the color cathode-ray tube of Embodiment 1, it is preferable-that the conductive film 6 is formed over the entire surface of the main lens opposed region 19. This can suppress the release of secondary electrons from the main lens opposed region 19. Thus, the increase in a potential of the main lens opposed region 19 can be suppressed. Consequently, the change with time in a convergence state of three electron beams can be suppressed satisfactorily, and the occurrence of color displacement also can be suppressed satisfactorily.

Furthermore, by providing the conductive film 6 in the main lens opposed region 19, the potential of the inner wall of the neck 2B in the region on the cathode 11 side from the region where the conductive film 6 is formed becomes stable in a low state, so that the spark from the control electrode 12, the accelerating electrode 13A, and the like can be suppressed. Furthermore, the width of the gap between the anode-side focusing electrode 14E and the anode 15 can be increased, so that the withstand voltage characteristics also can be enhanced.

According to the above-mentioned production method, compared to the case where a conductor for forming a conductive film is provided in the electron gun as in Comparative Example 1, Comparative Example 2, and Embodiment 3 described later, the material costs of the conductor can be reduced, and the process of attaching the conductor can be simplified. Furthermore, in the case of providing the conductor in the electron gun, the attachment position of the conductor varies largely, and the conductor may or may not come into contact with the electrodes. Because of this, when the conductor is heated, the amount of heat leaking from the conductor to the electrodes varies, which decreases the precision for forming the conductive film, with the result that the effect of suppressing a convergence drift is degraded. However, according to the above production method, the degradation of the effect of suppressing a convergence drift, caused by the decrease in precision of forming such a conductive film, can be prevented.

In the above, although the case where the anode-side focusing electrode 14E and the anode 15 are made of stainless steel has been described, the anode-side focusing electrode 14E and the anode 15 may be made of a material other than stainless steel. Depending upon the material for the anode-side focusing electrode 14E, the temperature at which the constituent material therefor evaporates changes. Therefore, it is preferable that the highest temperature of the anode-side focusing electrode 14E in the heating process is optimized depending upon the material. Furthermore, depending upon the material for the anode-side focusing electrode 14E, the evaporation amount of the constituent material therefor changes. Therefore, it is preferable that the temperature transition of the anode-side focusing electrode 14E in the heating process is optimized depending upon the material.

Hereinafter, one example (hereinafter, referred to as "Example") of the color cathode-ray tube according to Embodiment 1 will be described. The color cathode-ray tube of the Example was a 32-inch color cathode-ray tube. The conductive film 6 was formed through the temperature transition shown in FIG. 6. Furthermore, the width of the gap between the anode-side focusing electrode 14E and the anode 15 was 1.2 mm.

In the tube axis direction, the position P0 regarding the anode-side focusing electrode 14E was placed between the positions PL1 and PL2 regarding the conductive film 6. Distances L1, L2, and L3 shown in FIG. 3 were 6 mm, 2 mm, and 30 mm, respectively. In the vertical direction, the range occupied by the anode-side focusing electrode 14E (size HE in FIG. 4) was 10 mm, and the range occupied by the conductive film 6 (size HL in FIG. 4) was 18 mm. In the vertical direction, the range occupied by the conductive film 6 completely included the range occupied by the anode-side focusing electrode 14E.

For comparison, a color cathode-ray tube of Comparative Example 1 was produced, which was the same as that of the above-mentioned Example, except that a conductive film was provided in a region on the inner wall of the neck 2B opposed in the vertical direction to the connection portion between the focusing electrodes 14B and 14C, in place of the conductive film 6 in the Example.

Furthermore, a color cathode-ray tube of Comparative Example 2 was produced, which was the same as that of the above-mentioned Example, except that conductive films 36 (see FIG. 9 described later) were provided in regions on the inner wall of the neck 2B opposed in the horizontal direction to the gap between the focusing electrodes 14C and 14D (see JP 10(1998)-188843 A), in place of the conductive film 6 in the Example.

Furthermore, a color cathode-ray tube of Comparative Example 3 was produced, which was the same as that of the above-mentioned Example, except that the distances L1, L2 shown in FIG. 3 were 2 mm and 3 mm, respectively, regarding the range occupied by the conductive film 6 in the tube axis direction.

A method for producing the color cathode-ray tube of Comparative Example 1 will be described. In the same way as in the Example, the panel 1, the funnel 2 having the funnel portion 2A and the neck 2B, and the electron gun 4 were produced previously, respectively. Furthermore, a metallic ribbon (conductor) made of stainless steel or the like was produced previously. In the same way as in the Example, the phosphor screen forming process, the inner conductive film forming process, and the envelope forming process were performed.

Figure 7:
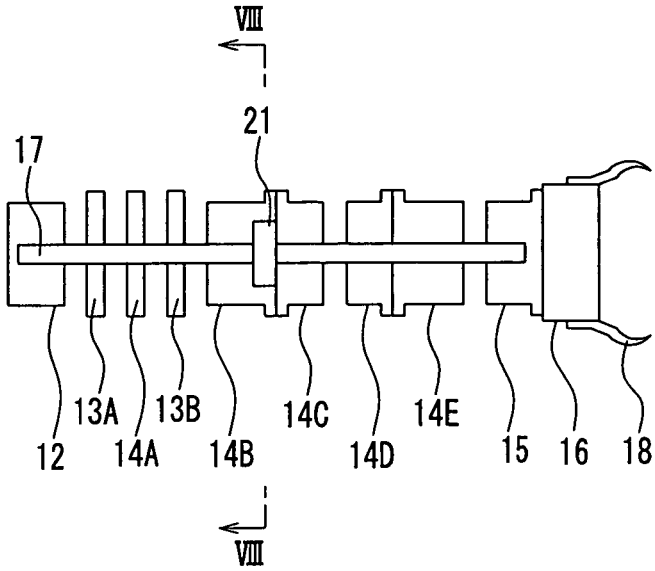
FIG. 7 is a view illustrating a process of attaching a metallic ribbon (conductor) in a method for producing a color cathode-ray tube of Comparative Example 1.
Figure 8:
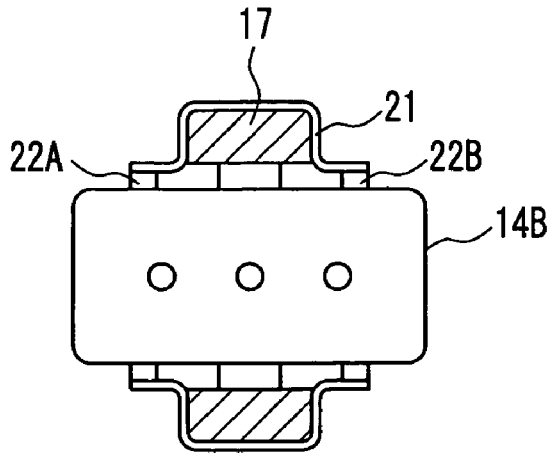
FIG. 8 is a cross-sectional view taken along a line VIII-VIII in FIG. 7.

FIG. 7 is a view illustrating the process of attaching a metallic ribbon (conductor) on the electron gun. FIG. 8 is a cross-sectional view taken along a line VIII-VIII in FIG. 7. As shown in FIGS. 7 and 8, a pair of metallic ribbons 21 were provided on the focusing electrode 14B so as to cover a pair of bead glasses (insulative holding portions) 17 placed in the vertical direction with the focusing electrode 14B interposed therebetween, and so as to be connected to lugs 22A and 22B of the focusing electrode 14B (conductor attaching process). After the envelope forming process and the conductor attaching process were completed, in the same way as in the Example, the electron gun fixing process and the exhausting process were performed.

After the exhausting process was completed, a coil was placed so as to surround the focusing electrode 14B of the electron gun from the outside of the neck 2B, and a high-frequency current was allowed to flow through the coil (heating process). Because of this, the pair of metallic ribbons 21 were subjected to high-frequency heating. In the heating process of Comparative Example 1, the center of the coil in the tube axis direction was matched with the center of the pair of metallic ribbons 21 in the tube axis direction. After the exhausting process was completed, in the same way as in the Example, the getter-flash process, the withstand voltage treatment process, the cathode activating process, and the like were performed. The color cathode-ray tube of Comparative Example 1 was produced through the above-mentioned processes.

Figure 9:
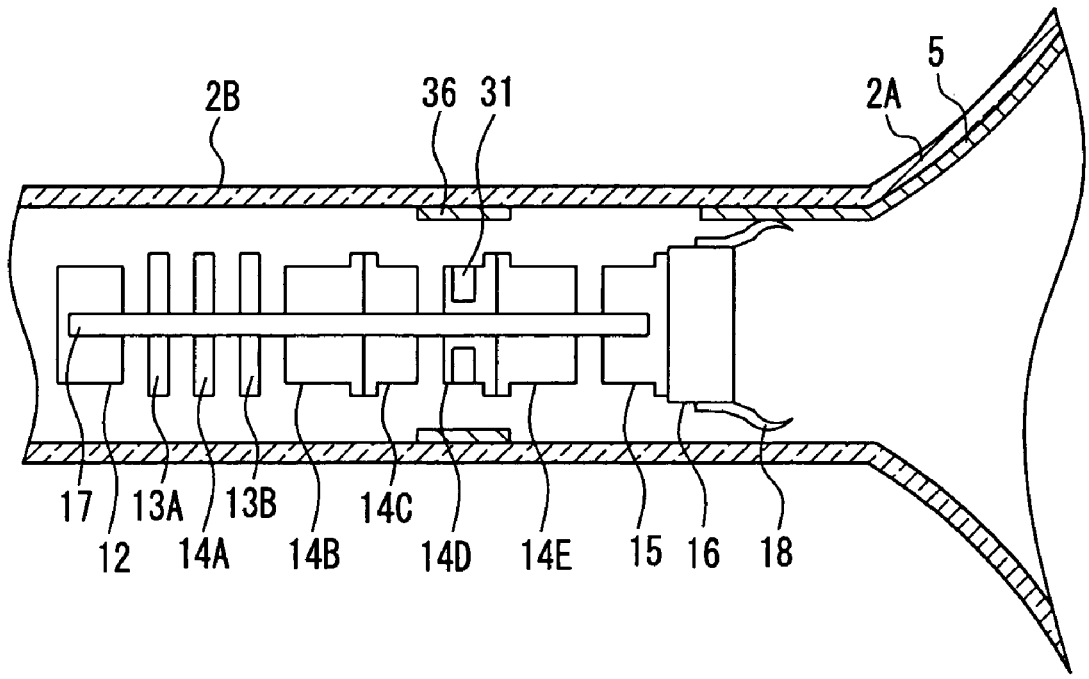
FIG. 9 is a view illustrating a process of attaching a metallic ribbon (conductor) in a method for producing a color cathode-ray tube of Comparative Example 2.

A method for producing the color cathode-ray tube of Comparative Example 2 will be described. FIG. 9 is a view illustrating the process of attaching a metallic ribbon (conductor). As shown in FIG. 9, the color cathode-ray tube of Comparative Example 2 was produced in accordance with the production method of Comparative Example 1, except that a pair of metallic ribbons (conductors) 31 were attached to both side surfaces in the horizontal direction of the focusing electrode 14D. Consequently, the conductive films 36 were formed in the color cathode-ray tube of Comparative Example 2.

A method for producing the color cathode-ray tube of Comparative Example 3 will be described. The color cathode-ray tube of Comparative Example 3 was produced in accordance with the same production method as that of the Example, except for the size and position of the coil in the heating process. The heating process of Comparative Example 3 will be described. The size in the tube axis direction of the coil used in Comparative Example 3 was ¾ of the size in the tube axis direction of the coil 20 used in the Example. In Comparative Example 3, the position in the tube axis direction of the coil was adjusted so that, in the tube axis direction, the position of an end on the panel side of the coil was substantially matched with the position of a connection surface between the anode 15 and the shield cup 16. The position in the tube axis direction of an end on the panel side of the coil in Comparative Example 3 was shifted by about 5 mm to the panel side, compared with that in the Example. The heating process was performed by allowing a high-frequency current to flow through the coil in the same way as in the Example except for the above size and shift. Consequently, a conductive film, in which the distances L1 and L2 shown in FIG. 3 respectively were 2 mm and 3 mm, was formed.

Figure 10:
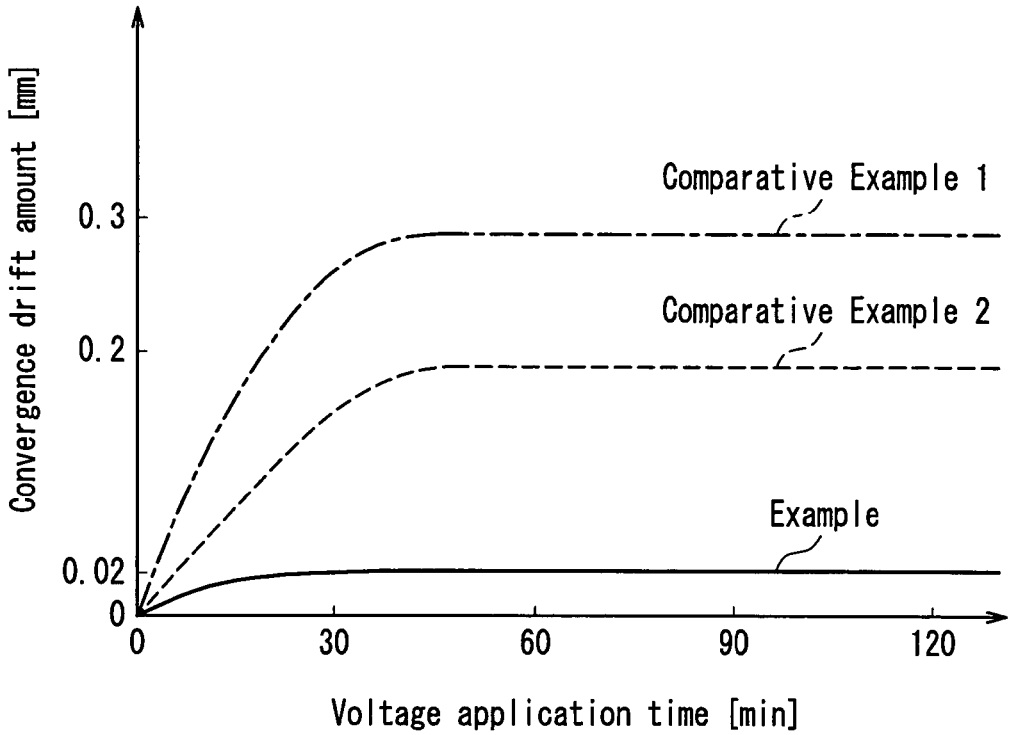
FIG. 10 is a graph showing a relationship between a voltage application time with respect to color cathode-ray tubes of the Example and Comparative Examples 1, 2, and a convergence drift amount.

The convergence drift in the three kinds of color cathode-ray tubes of the Example, and Comparative Examples 1 and 2 will be described. FIG. 10 is a graph showing a relationship between the voltage application time to each electrode of each color cathode-ray tube of the Example and Comparative Examples 1, 2, and the convergence drift amount. In FIG. 10, a solid line represents the Example, alternate long and short dashed lines represent Comparative example 1, and a broken line represents Comparative Example 2. The convergence drift amount was measured at the center (in the vicinity of an intersection between the phosphor screen and the tube axis) of the phosphor screen. As shown in FIG. 10, the convergence drift amount was 0.02 mm in the Example. On the other hand, the convergence drift amount was 0.3 mm in Comparative Example 1, and the convergence drift amount was 0.2 mm in Comparative Example 2. As is understood from FIG. 10, in the color cathode-ray tube of the Example, a convergence drift with time was suppressed satisfactorily.

Furthermore, as a result of observing the color displacement of the three kinds of color cathode-ray tubes, color displacement did not occur over the entire surface of the phosphor screen in the Example, and color displacement occurred in Comparative Examples 1 and 2.

Figure 11:
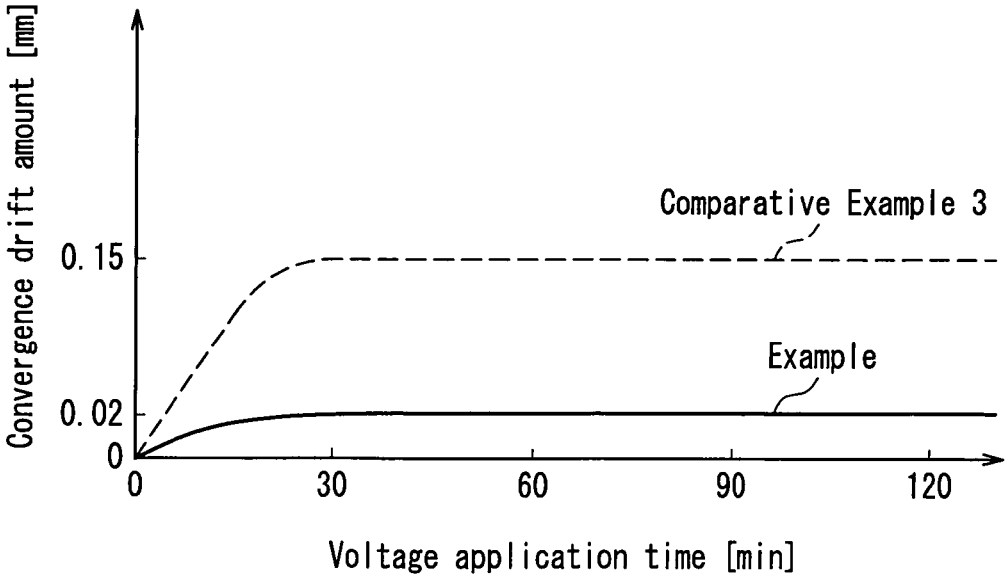
FIG. 11 is a graph showing a relationship between a voltage application time with respect to color cathode-ray tubes of the Example and Comparative Example 3 and a convergence drift amount.

The convergence drift in the two kinds of color cathode-ray tubes in the Example and Comparative Example 3 will be described. FIG. 11 is a graph showing a relationship between the voltage application time to each electrode of each color cathode-ray tube of the Example and Comparative Example 3, and the convergence drift amount. In FIG. 11, a solid line represents the Example, and a broken line represents Comparative Example 3. The convergence drift amount was measured at the center of the phosphor screen. As shown in FIG. 11, the convergence drift amount was 0.02 mm in the Example. On the other hand, the convergence drift amount was 0.15 mm in Comparative Example 3. As is understood from FIG. 11, the convergence drift was suppressed more satisfactorily in the color cathode-ray tube of the Example, compared with that of Comparative Example 3. The difference therebetween is ascribed to the difference in a potential of the conductive films. In the Example, most of the conductive film 6 in the tube axis direction is opposed to the anode-side focusing electrode 14E, so that the potential of the conductive film 6 becomes stable at a potential close to the anode-side focusing electrode 14E. In contrast, in Comparative Example 3, most of the conductive film in the tube axis direction is opposed to the main lens formation region and the anode 15, so that the potential of the conductive film becomes stable at a potential close to the intermediate value -between the potential of the anode-side focusing electrode 14E and the potential of the anode 15. In the Example and Comparative Example 3, a difference in a convergence drift is caused due to the difference in a potential of the conductive films.

In Embodiment 1, one example has been described with respect to the color cathode-ray tube in which an electron gun of a static focus type with a constant focus voltage is mounted. However, in the color cathode-ray tube of the present invention, an electron gun of a dynamic focus type may be mounted, in which a dynamic focus voltage superimposed with an AC component varying in synchronization with a deflection magnetic field is applied to the focusing electrode. This will be described with reference to FIG. 12.

Figure 12:
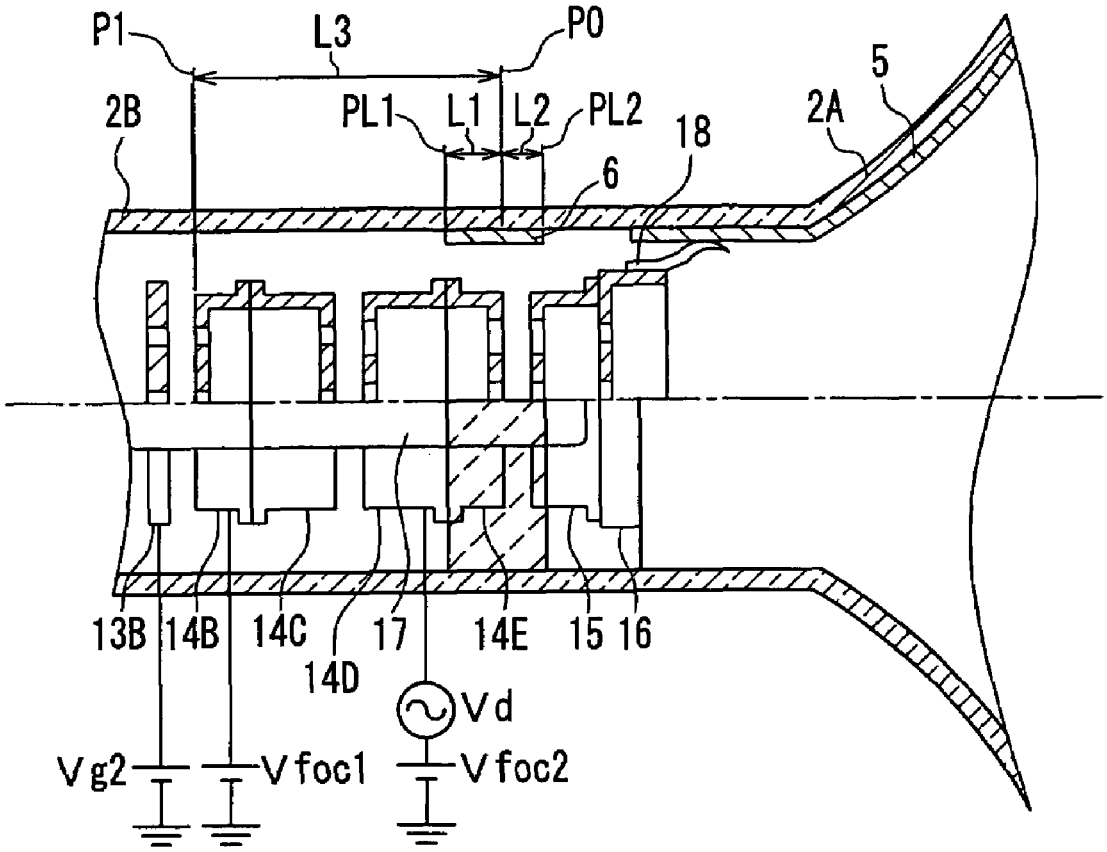
FIG. 12 is a schematic partial cross-sectional side view showing an exemplary configuration in the vicinity of focusing electrodes of an electron gun of a dynamic focus type of the color cathode-ray tube according to Embodiment 1 of the present invention.

In the case of the electron gun of a dynamic focus type, generally, a static focus voltage Vfoc1 is applied to the focusing electrodes 14B, 14C, and a dynamic focus voltage, in which a static focus voltage Vfoc2 is superimposed with an AC component Vd varying in synchronization with a deflection magnetic field, is applied to the focusing electrodes 14D, 14E. Consequently, a dynamic focus lens is formed between the focusing electrodes 14C and 14D. A voltage Vg2 applied to the accelerating electrode 13B is about 600 V, and the voltage Vfoc1 applied to the focusing electrodes 14B, 14C is about 8 kV, which is substantially the same as the static focus voltage Vfoc2 applied to the focusing electrodes 14D, 14E. The AC component Vd applied to the focusing electrodes 14D, 14E is 1 to 2 kV. In this case, although the potential of the focusing electrodes 14B, 14C is slightly different from that of the focusing electrodes 14D, 14E, the difference therebetween is 2 kV or less. Therefore, the focusing electrodes 14B, 14C and the focusing electrodes 14D, 14E are considered to be substantially the same. More specifically, the electrodes 14D, 14C, 14B among a plurality of electrodes arranged on the beam generating portion side with respect to the anode-side focusing electrode 14E are supplied with substantially the same voltage as that of the anode-side focusing electrode 14E, and are arranged continuously-from the anode-side focusing electrode 14E. Thus, in the case where the electron gun of a dynamic focus type is mounted, the position P1 in the present invention is defined by the position in the tube axis direction of an end on the beam generating side of the focusing electrode 14B. Thus, the positions P0, PL1, PL2 and the distances L1, L2, L3 in the present invention in the case where the electron gun of a dynamic focus type is mounted are as shown in FIG. 12, in the same way as in FIG. 3 showing the case where the electron gun of a static focus type is mounted. Even in the color cathode-ray tube with the electron gun of a dynamic focus type mounted thereon, if the following conditions are satisfied, the effect similar to that of Embodiment 1 is obtained. More specifically, in the tube axis direction, the position P0 is placed between the positions PL1 and PL2. Furthermore, relationships: L1>L2 and L1<L3 are satisfied. Furthermore, in the vertical direction, the range occupied by the conductive film 6 includes and is larger than the range occupied by the anode-side focusing electrode 14E.

The distance L3 of the present invention will be described further. The distance L3 also can be defined as a length in the tube axis direction of the electrode group that is supplied with a focus voltage irrespective of whether or not the focus voltage is superimposed with the AC component Vd varying in synchronization with a deflection magnetic field and that is arranged continuously from the anode-side focusing electrode.

Embodiment 2

In Embodiment 2, a specific example of the color cathode-ray tube according to the present invention will be described. The color cathode-ray tube of Embodiment 2 is produced by a production method different from that of Embodiment 1. The configuration of the color cathode-ray tube is substantially the same as that of Embodiment 1, so that only the production method will be described below.

In the same way as in the production method of Embodiment 1, the processes up to the exhausting process are performed. Next, although the heating process of forming a conductive film is performed in Embodiment 1, a getter-flash process is performed instead of the heating process in the present embodiment.

After the getter-flash process is completed, the withstand voltage treatment process is performed. In the withstand voltage treatment process, when the withstand voltage treatment is performed between the anode-side focusing electrode 14E and the anode 15, the potential difference therebetween is set to be extremely large, whereby a spark is allowed to be generated therebetween, and the anode-side focusing electrode 14E and/or the anode 15 are heated with thermal energy from the spark. Because of this, a material constituting the anode-side focusing electrode 14E and/or the anode 15 is vapor-deposited on the inner wall of the neck 2B to form the conductive film 6.

After the withstand voltage treatment process is completed, a cathode activating process, and the like are performed, whereby a color cathode-ray tube is completed.

When a spark is allowed to be generated between the anode-side focusing electrode 14E and the anode 15 in the withstand voltage treatment process, only surface layer portions of regions opposed to each other of the anode-side focusing electrode 14E and the anode 15 are heated partially. Therefore, the changes in the position and shape of the anode-side focusing electrode 14E and the anode 15 are extremely unlikely to occur.

Embodiment 3

In Embodiment 3, a specific example of the color cathode-ray tube according to the present invention will be described. The color cathode-ray tube of Embodiment 3 is produced by a production method different from those of Embodiments 1 and 2. The configuration of the color cathode-ray tube is substantially the same as that of Embodiment 1. Therefore, only the production method will be described below.

The color cathode-ray tube of Embodiment 3 is produced in the same way as in Comparative Examples 1 and 2, except that the attachment position of a conductor (a metal foil or a metallic ribbon) is different. That is, the process of attaching a conductor onto the anode-side focusing electrode 14E of the electron gun is performed before the electron gun fixing process, and a constituent material for the conductor is vapor-deposited on the inner wall of the neck 2B by heating the conductor in the heating process, whereby the conductive film 6 isolated from the inner conductive film 5 is formed.

As the method for heating the conductor, any known method may be used. Preferably, the conductor is heated by high-frequency heating using a coil. This is because the conductor can be heated efficiently to a temperature higher than that of the electrode such as the anode-side focusing electrode 14E. This also is because the surface of the conductor opposed to the neck 2B can be heated selectively.

The present invention can be used for suppressing a convergence drift of three electron beams, thereby enhancing the color purity of a color display in a color cathode-ray tube. Furthermore, the present invention can be used for enhancing the image quality of a color cathode-ray tube of a television, a computer display, or the like provided with a color cathode-ray tube.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color cathode-ray tube, comprising:

an envelope having a funnel composed of a funnel portion and a neck, and a panel;

a phosphor screen provided on an inner wall of the panel;

an electron gun provided in an inner space of the neck, and having a beam generating portion for controlling generation of three electron beams arranged in an in-line direction, a plurality of focusing electrodes for controlling a focusing of the three electron beams, and an anode; and an inner conductive film formed on an inner wall of the funnel portion and in a part of an inner wall of the neck, and electrically connected to the anode, the color cathode-ray tube further comprising a conductive film isolated from the inner conductive film on the inner wall of the neck, wherein, among the plurality of focusing electrodes, an electrode placed at a position closest to the anode is an anode-side focusing electrode, and a position P0 is defined as a position in a tube axis direction of an end on the anode side of the anode-side focusing electrode placed at a position closest to the anode side, among electrodes supplied with substantially the same voltage as that of the anode-side focusing electrode and arranged continuously from the anode-side focusing electrode, a position P1 is defined as a position in the tube axis direction of an end on the beam generating portion side of an electrode placed at a position closest to the beam generating portion side, and in the tube axis direction, a position PL1 is defined as a position of an end on the beam generating portion side of the conductive film, and a position PL2 is defined as a position of an end on the panel side of the conductive film, in the tube axis direction, the position P0 is placed between the position PL1 and the position PL2, assuming that a distance in the tube axis direction from the position P0 to the position PL1 is L1, a distance in the tube axis direction from the position P0 to the position PL2 is L2, and a distance in the tube axis direction from the position P0 to the position P1 is L3, the following relationships:

$$L1>L2$$

$$L1<L1$$

are satisfied, and in a direction orthogonal to a tube axis and the in-line direction, a range occupied by the conductive film includes and is larger than a range occupied by the anode-side focusing electrode.

2. The color cathode-ray tube according to claim 1, wherein the conductive film is a vapor-deposited metal film.

3. The color cathode-ray tube according to claim 1, wherein a gap between the anode-side focusing electrode and the anode is 1.0 mm or more.

* * * * *